US011193715B2

(12) United States Patent
Adomat

(10) Patent No.: US 11,193,715 B2
(45) Date of Patent: Dec. 7, 2021

(54) METHOD AND SYSTEM FOR COOLING A FLUID WITH A MICROCHANNEL EVAPORATOR

(71) Applicant: Hyfra Industriekuhlanlagen GmbH, Krunkel (DE)

(72) Inventor: Berthold Adomat, Krunkel (DE)

(73) Assignee: Hyfra Industriekuhlanlagen GmbH, Krunkel (DE)

( * ) Notice: Subject to any disclaimer, the term of this patent is extended or adjusted under 35 U.S.C. 154(b) by 0 days.

(21) Appl. No.: 15/298,720

(22) Filed: Oct. 20, 2016

(65) Prior Publication Data

US 2017/0115067 A1 Apr. 27, 2017

Related U.S. Application Data

(60) Provisional application No. 62/245,387, filed on Oct. 23, 2015.

(51) Int. Cl.
*F28D 1/047* (2006.01)
*F28D 1/053* (2006.01)
(Continued)

(52) U.S. Cl.
CPC ..... *F28D 1/0476* (2013.01); *F28D 1/0213* (2013.01); *F28D 1/0435* (2013.01);
(Continued)

(58) Field of Classification Search
CPC .. F28D 1/0213; F28D 1/05383; F28D 1/0476; F28D 1/0475; F28D 7/06;
(Continued)

(56) References Cited

U.S. PATENT DOCUMENTS 4,210,202 A 7/1980 Boyer et al.
4,579,304 A 4/1986 Williams
(Continued)

FOREIGN PATENT DOCUMENTS

DE 2638468 A1 3/1977
DE 3328311 A1 2/1985
(Continued)

OTHER PUBLICATIONS

FR 2914407 A1 machine translation.*
(Continued)

*Primary Examiner* — Gordon A Jones
(74) *Attorney, Agent, or Firm* — Shackelford, Bowen, McKinley & Norton, LLP

(57) ABSTRACT

A microchannel evaporator includes a plurality of microchannels. Each of the plurality of microchannels includes a first end and a second end. A first end-tank is coupled to each first end of the plurality of microchannels and a second end-tank is coupled to each second end of the plurality of microchannels. A second-fluid inlet is coupled to either the first end-tank or the second end-tank and configured to receive a fluid into the microchannel evaporator and a second-fluid outlet is coupled to either the first end-tank or the second end-tank and configured to expel the fluid from the microchannel evaporator. Each microchannel of the plurality of microchannels includes at least one bend along a length thereof.

9 Claims, 7 Drawing Sheets

(51) Int. Cl.

| | |
|---|---|
| ***F28D 1/02*** | (2006.01) |
| ***F28D 7/06*** | (2006.01) |
| ***F28D 1/04*** | (2006.01) |
| ***F28F 9/02*** | (2006.01) |
| ***F28F 13/12*** | (2006.01) |
| ***F28F 19/04*** | (2006.01) |
| ***F28F 19/06*** | (2006.01) |
| *F28D 21/00* | (2006.01) |

(52) U.S. Cl.
CPC ..... *F28D 1/0471* (2013.01); *F28D 1/0475* (2013.01); *F28D 1/05383* (2013.01); *F28D 7/06* (2013.01); *F28F 9/0202* (2013.01); *F28F 13/125* (2013.01); *F28F 19/04* (2013.01); *F28F 19/06* (2013.01); *F28D 2021/0071* (2013.01); *F28F 2260/02* (2013.01)

(58) Field of Classification Search
CPC ..... F28D 2021/0071; F28D 2001/028; F28D 2001/026; F28D 2021/0085; F28F 9/0202; F28F 2260/00; F28F 2260/02; F25B 39/00; F25B 39/02
See application file for complete search history.

(56) References Cited

U.S. PATENT DOCUMENTS 4,839,951 A 6/1989 Boula et al.
4,966,230 A * 10/1990 Hughes ..... F28D 1/035 165/150
6,126,079 A 10/2000 Shoemaker
6,546,999 B1 * 4/2003 Dienhart ..... F28D 1/0476 165/150
7,013,953 B2 3/2006 Jung
7,267,160 B2 9/2007 Shincho et al.
7,667,057 B2 * 2/2010 Regiert ..... A61K 8/361 424/70.13
7,779,898 B2 * 8/2010 Morrison ..... F28C 1/14 165/150
7,921,904 B2 * 4/2011 Matter ..... F28D 1/0417 165/150
10,132,538 B2 * 11/2018 Fritz ..... F25B 40/00
2003/0000686 A1 1/2003 Kester
2003/0066632 A1 * 4/2003 Bishop ..... F24H 1/43 165/133
2004/0261983 A1 * 12/2004 Hu ..... F28D 1/0443 165/148
2005/0056049 A1 * 3/2005 Sanada ..... F25B 39/04 62/507
2005/0173102 A1 8/2005 Jung
2005/0217831 A1 * 10/2005 Manaka ..... F28D 1/0443 165/140
2006/0102332 A1 * 5/2006 Taras ..... F25B 39/028 165/174
2009/0084131 A1 * 4/2009 Reifel ..... F24F 1/18 62/515
2009/0084532 A1 * 4/2009 Agee ..... F28D 7/1692 165/170
2009/0173102 A1 * 7/2009 Ogasawara ..... F28D 1/0417 62/498
2009/0173483 A1 * 7/2009 Beamer ..... B21D 53/06 165/173
2010/0263847 A1 10/2010 Alahyari et al.
2011/0107512 A1 * 5/2011 Gilbert ..... E03C 1/00 4/596
2011/0284185 A1 * 11/2011 Cullen ..... F24F 1/0029 165/104.11
2012/0151950 A1 * 6/2012 Jagusztyn ..... F28D 7/1684 62/228.1
2012/0193080 A1 * 8/2012 Rasmussen ..... F28D 7/06 165/173
2013/0068606 A1 3/2013 Lahnstein
2013/0098591 A1 * 4/2013 Taras ..... F28D 1/0477 165/181
2013/0213073 A1 8/2013 Fritz et al.
2014/0090827 A1 * 4/2014 Iguchi ..... F28F 9/02 165/176
2014/0262188 A1 * 9/2014 Sistla ..... F28F 17/005 165/182
2016/0010905 A1 1/2016 Wang et al.
2016/0377348 A1 * 12/2016 Fujisawa ..... F28F 9/001 165/175
2017/0115066 A1 4/2017 Adomat
2017/0254605 A1 9/2017 Blomgren
2018/0051945 A1 2/2018 Hanov et al.

FOREIGN PATENT DOCUMENTS

DE 19703729 C1 7/1998
DE 102006050922 A1 4/2008
EP 1607707 A1 12/2005
EP 3029407 A1 6/2016
EP 3159645 A1 4/2017
FR 2914407 A1 * 10/2008 ..... F25B 39/022
FR 2914407 A1 10/2008
JP S53106962 A 9/1978
WO WO-2010011452 A2 * 1/2010 ..... F24F 13/30
WO WO-2011115626 A1 9/2011
WO WO-2016009565 A1 * 1/2016 ..... F25B 39/00

OTHER PUBLICATIONS

WO2016009565A1 mt (Year: 2016).*
U.S. Appl. No. 15/298,691, Adomat.
U.S. Appl. No. 16/378,884, Lahnstein et al.

* cited by examiner

METHOD AND SYSTEM FOR COOLING A FLUID WITH A MICROCHANNEL EVAPORATOR

CROSS-REFERENCE TO RELATED APPLICATIONS

This application claims priority to and incorporates by reference the entire disclosure of U.S. Provisional Patent Application No. 62/245,387, filed on Oct. 23, 2015.

TECHNICAL FIELD

The present invention relates generally to heat exchangers and more particularly, but not by way of limitation, to a microchannel evaporator ("MCE").

BACKGROUND

Machines with moving parts often make use of a fluid (e.g., oil) to lubricate the moving parts and to provide a medium to dissipate some of the heat that is generated from operation of the machine. In some instances, the fluid is circulated through the machine to lubricate moving parts and to dissipate heat from the motor. The dissipation of heat from the machine may be improved by circulating the fluid from the machine to an external cooling apparatus, such as a heat exchanger.

One method for cooling the fluid of the machine is to use a coiled-tube heat exchanger. An example of a coiled-tube heat exchanger is shown in FIGS. 1A and 1B. Coiled-tube heat exchangers, while effective at removing heat from a fluid, have certain drawbacks. For example, coiled-tube heat exchangers can be difficult and expensive to manufacture. Furthermore, coiled-tube heat exchangers can also be difficult to clean due to their compact bundling of the coiled tubes.

SUMMARY

A microchannel evaporator includes a plurality of microchannels. Each of the plurality of microchannels includes a first end and a second end. A first end-tank is coupled to each first end of the plurality of microchannels and a second end-tank is coupled to each second end of the plurality of microchannels. A second-fluid inlet is coupled to either the first end-tank or the second end-tank and configured to receive a fluid into the microchannel evaporator and a second-fluid outlet is coupled to either the first end-tank or the second end-tank and configured to expel the fluid from the microchannel evaporator. Each microchannel of the plurality of microchannels includes at least one bend along a length thereof.

A heat exchanger system includes a fluid tank that includes a first-fluid inlet to permit a first fluid to enter the fluid tank and a first-fluid outlet to permit the first fluid to exit the fluid tank. A first microchannel evaporator is disposed within the fluid tank and includes a plurality of microchannels. Each of the plurality of microchannels has a first end and a second end. A first end-tank is coupled to each first end of the plurality of microchannels and a second end-tank is coupled to each second end of the plurality of microchannels. A second-fluid inlet is coupled to either the first end-tank or the second end-tank and configured to receive a fluid into the first microchannel evaporator and a second-fluid outlet is coupled to either the first end-tank or the second end-tank and configured to expel the fluid from the first microchannel evaporator. Each of the plurality of microchannels includes a bend along a length thereof.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
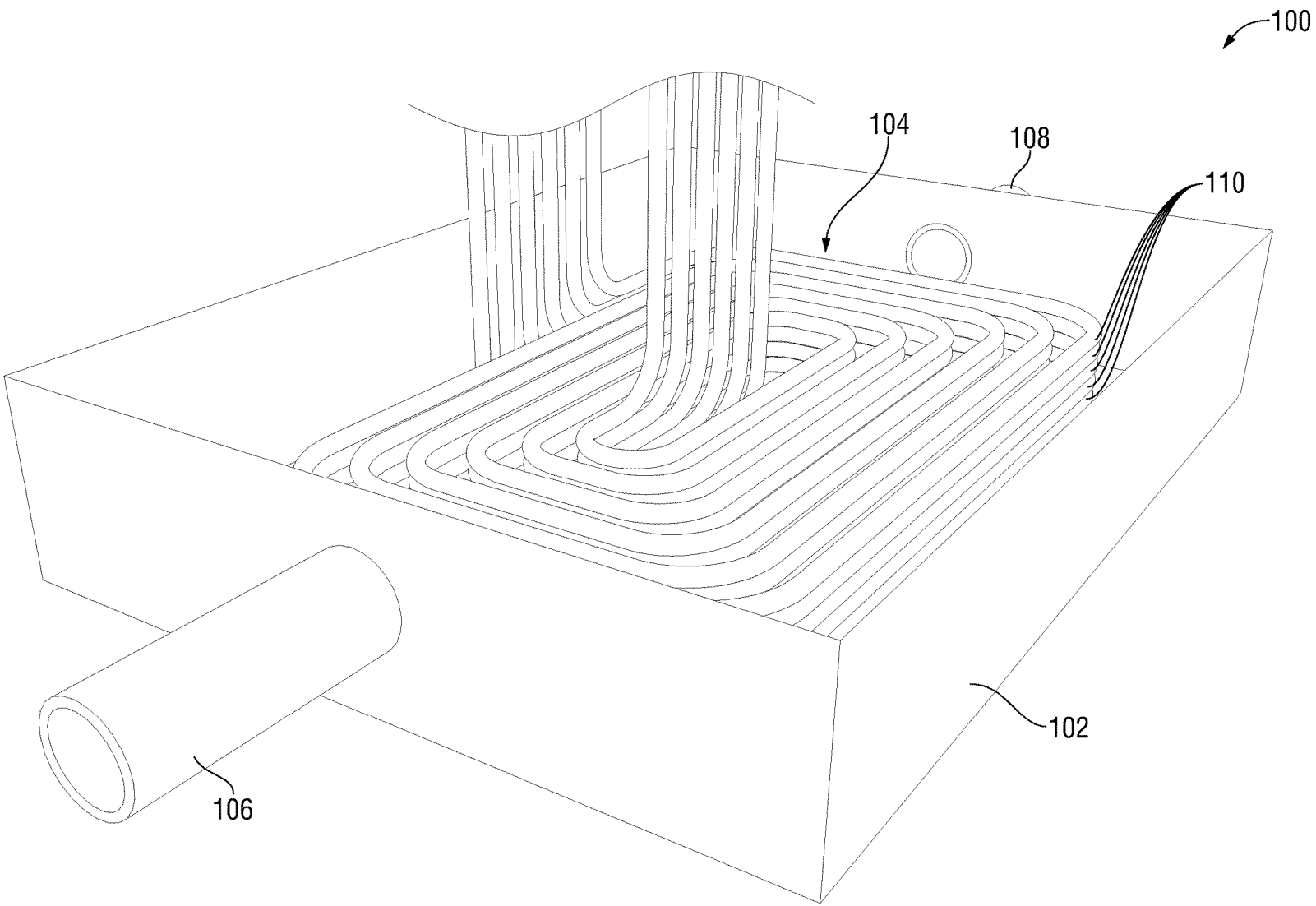
FIG. 1(Prior Art)
FIG. 1 illustrates a prior art coiled-tube heat exchanger system.

FIG. 1 illustrates a prior art coiled-tube heat exchanger system 100 that utilizes a fluid tank 102 in which a flat evaporator 104 is submerged. The flat evaporator 104 comprises a series of coiled tubes. The fluid tank 102 includes a first-fluid inlet 106 for receiving a first fluid from, for example, a machine and a first-fluid outlet 108 for returning the first fluid to the machine. In some embodiments, the fluid tank 102 is open to the atmosphere. In other embodiments, the fluid tank 102 is sealed and a pressure within the fluid tank 102 may be controlled as desired. The flat evaporator 104 may be formed from a plurality of tubes, each of which is bent to form a coil 110. As shown in FIG. 1, the flat evaporator 104 includes six coils 110.

In order to cool the first fluid as it passes through the fluid tank 102, a second fluid is passed through each tube of the flat evaporator 104. The first fluid is circulated between the machine and the fluid tank 102, and may be, for example, oil that is used to lubricate at least one of and cool the machine. In a typical embodiment, the second fluid is circulated between the flat evaporator 104 and a cooling system, and may be, for example, a coolant or refrigerant (e.g., R410A). Any cooling system may be used provided that the cooling system provides enough cooling duty to absorb a desired amount of heat from the first fluid. The term "first fluid" is used throughout to describe a fluid that is to be cooled and the term "second fluid" is used throughout to describe a fluid that is used to absorb heat from the first fluid.

While use of the flat evaporator 104 may be an effective solution to generally remove heat from the first fluid, assembly of the flat evaporator 104 has inherent complications. For example, assembling a single flat evaporator 104 may take up to two hours. In addition, it should be noted that due to the overlapping, compact design of the flat evaporator 104 it may be difficult to clean debris and sediment from fluid that becomes deposited on and around the flat evaporator 104. In addition, as shown in FIG. 1, each end of each tube of the flat evaporator 104 is connected to a manifold to seal a flow path for the second fluid to pass through. The six-coil arrangement of the flat evaporator 104 results in twelve such connections. These connections make the coiled-tube heat exchanger system 100 more complicated, and each of the connections is a location at which a leak may form.

Figure 2:
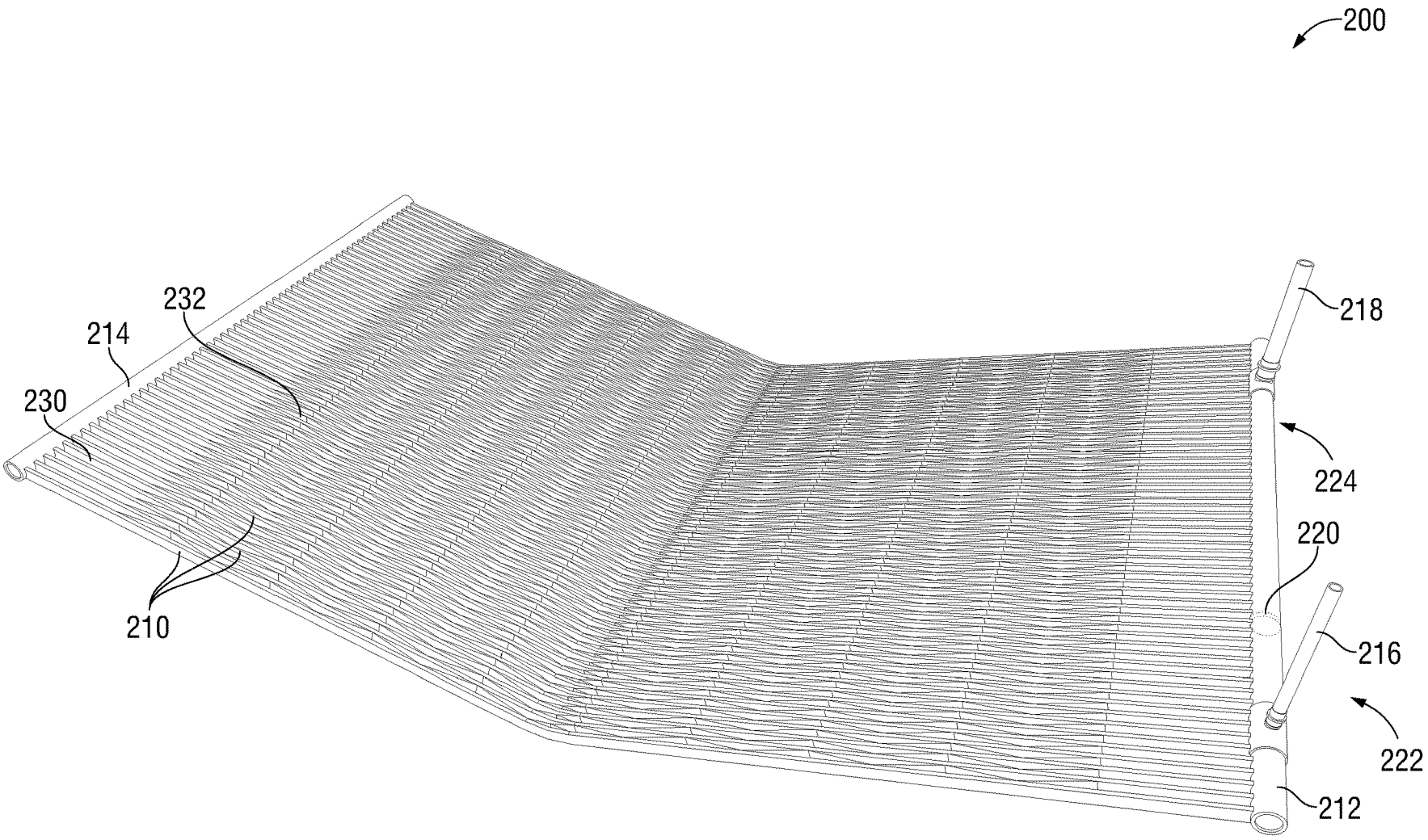
FIG. 2 is an isometric view of an exemplary microchannel evaporator.

FIG. 2 is an isometric view of an exemplary MCE 200. The MCE 200 includes a plurality of microchannels 210 that are coupled at a first end to a first end-tank 212 and at a second end to a second end-tank 214. In a typical embodiment, each microchannel 210 of the plurality of microchannels 210 is spaced apart from adjacent microchannels 210 so that gaps 230 are formed therebetween. As shown in FIG. 2, each microchannel 210 of the plurality of microchannels 210 includes a slight bend along its length, giving the MCE 200 a substantial "chevron" shape. In a typical embodiment, each microchannel 210 includes an interior passageway through which the second fluid can flow. In a typical embodiment, each microchannel 210 has a rectangular cross-section. In other embodiments, the plurality of microchannels 210 may have other cross-sections, such as, for example, square, round, and the like. The dimensions of the plurality of microchannels 210 can vary depending on preferred design parameters. For example, a width, height, and length of the plurality of microchannels 210 can be changed in accordance with design parameters. The distance between each of the plurality of microchannels 210 that defines the size of the gaps 230 between the plurality of microchannels 210 may also be varied.

The MCE 200 includes a second-fluid inlet 216 that receives the second fluid from the cooling system and a second-fluid outlet 218 that directs the second-fluid back to the cooling system. In the embodiment shown in FIG. 2, the second-fluid inlet 216 and the second-fluid outlet 218 communicate the second fluid to and from, respectively, the first end-tank 212. In such an embodiment, the first end-tank 212 includes a baffle 220 that separates the first end-tank 212 into an inlet side 222 and an outlet side 224. In other embodiments, the second-fluid inlet 216 may be located on the first end-tank 212 and the second-fluid outlet 218 may be located on the second end-tank 214. The baffle 220 causes the second fluid entering the first end-tank 212 to flow through a first set of microchannels 226 to the second end-tank 214. After the second fluid reaches the second end-tank 214, the second fluid flows through a second set of microchannels 228 that directs the second fluid back to the first end-tank 212 and out of the second-fluid outlet 218. As shown in FIG. 2, the baffle 220 is located closer to the second-fluid inlet 216 than the second-fluid outlet 218 so that the second set of microchannels 228 includes more microchannels 210 than the first set of microchannels 226. Such an arrangement provides a greater fluid volume in the second set of microchannels 228 to accommodate second fluid that has undergone a phase change from liquid to gas as a result of the second fluid absorbing heat from the first fluid. In other embodiments, the baffle 220 may be located anywhere along a length of the first end-tank 212 as desired.

During operation of the MCE 200, the first fluid surrounds the MCE 200 and is permitted to flow through gaps 230 between the plurality of microchannels 210. As the first fluid moves past the MCE 200, heat is absorbed from the first fluid into the second fluid. In some embodiments, the gaps 230 include fins 232 disposed between adjacent microchannels 210. The fins 232 aid in the transfer of heat from the first fluid to the second fluid within the plurality of microchannels 210 by increasing a surface area that the first fluid comes into contact with. When using a refrigerant as the second fluid, the refrigerant that passes through the MCE 200 may enter the second-fluid inlet 216 as a liquid and exit the second-fluid outlet 218 as a vapor. The phase transformation from liquid to vapor results from the absorption of heat from the first fluid to the refrigerant. In such an embodiment, the second-fluid outlet 218 may have a larger diameter than the second-fluid inlet 216 to compensate for the increased volume of the gas phase relative to the liquid phase.

In some embodiments, the second-fluid inlet 216 may be located on the first end-tank 212 and the second-fluid outlet 218 may be located on the second end-tank 214. In such an embodiment, the baffle 220 is not necessary. With no baffle 220 in place, the second fluid enters the second-fluid inlet 216 and flows into the first end-tank 212. The second fluid is then distributed through the plurality of microchannels 210 to the second end-tank 214 and exits the second-fluid outlet 218. In some embodiments, two or more second-fluid inlets may be used to improve distribution of the second fluid into the MCE 200.

In some embodiments, multiple baffles 220 may be included to cause the second fluid to flow back and forth between the first end-tank 212 and the second end-tank 214 before the second fluid exits the MCE 200. Causing the second fluid to pass back and forth between the first end-tank 212 and the second end-tank 214 increases the length of the flow path of the second fluid within the MCE 200, and thus increases the amount of indirect contact between the second fluid in the plurality of microchannels 210 and the first fluid that flows around the MCE 200.

In comparison to the flat evaporator 104 of FIG. 1, the MCE 200 includes a single second-fluid inlet 216 and a single second-fluid outlet 218. The reduction in inlets/outlets from twelve to the two of the exemplary MCE 200 makes the assembly process easier and increases reliability by reducing the number of potential leak points. A further benefit of the MCE 200 is that, compared to the flat evaporator 104, the MCE 200 uses a reduced amount of the second fluid. In some embodiments, a reduction in the amount of the second fluid needed is as high as 60-70%. This reduction is possible because an internal volume of the coiled tubes that comprise the flat evaporator 104 is typically much greater than an internal volume of the plurality of microchannels 210. Reduction of the amount of the second fluid used is desirable from both a cost perspective and an environmental perspective.

Another benefit of the MCE 200 over the flat evaporator 104 is that the amount of labor to construct the MCE 200 is greatly reduced in comparison to the flat evaporator 104. Due to the complex geometries involved, manufacturing the parts for the flat evaporator 104 and assembly of the flat evaporator 104 is difficult and expensive compared to the MCE 200. The relative simplicity of the MCE 200 also makes it easy to remove the MCE 200 from a fluid tank in comparison to the flat evaporator 104. The elimination of the numerous connections for the flat evaporator 104 also makes the MCE 200 a more robust system that the flat evaporator 104, which is more likely to develop a leak.

Figure 3:
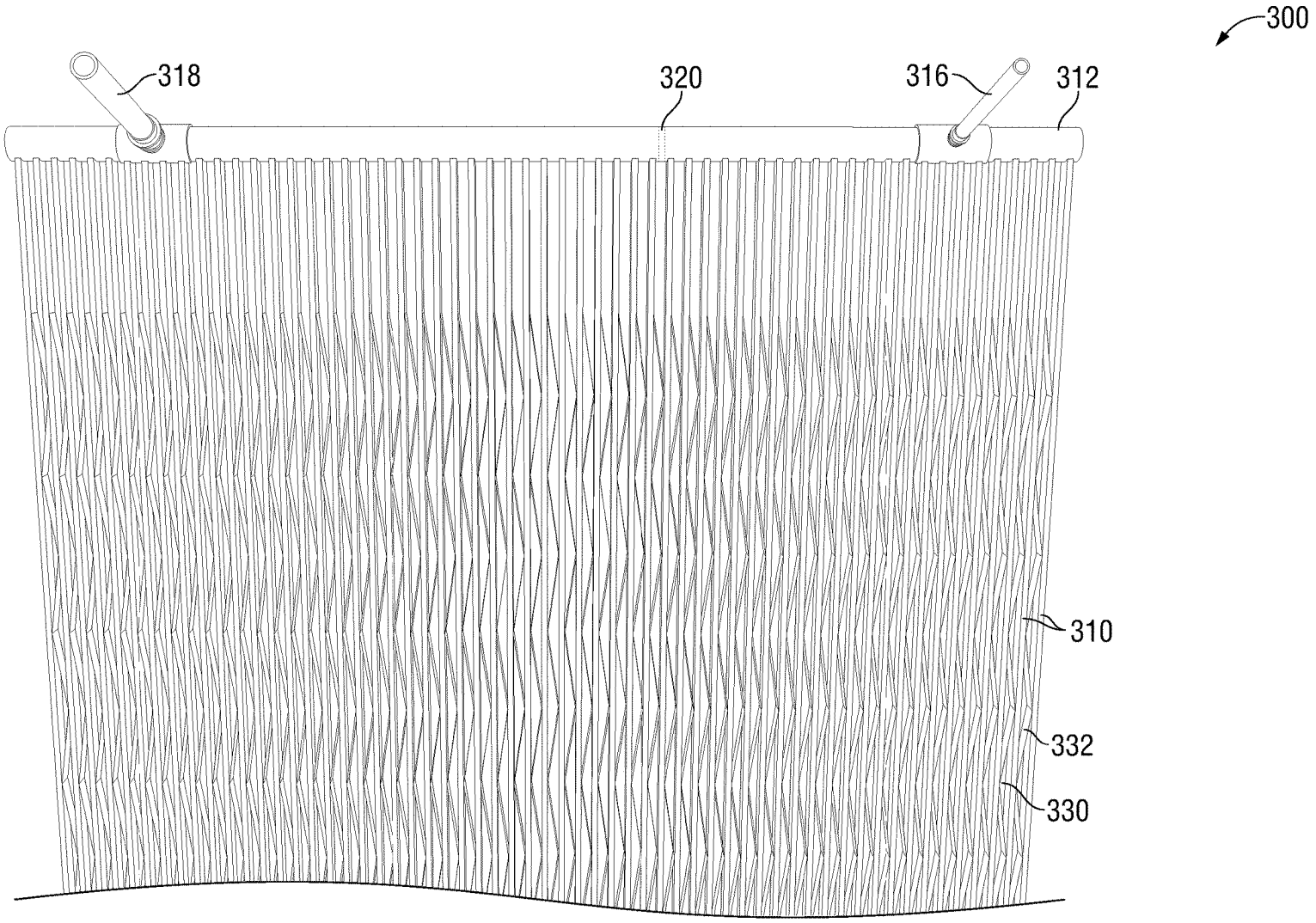
FIG. 3 illustrates partial close-up view of an exemplary microchannel evaporator.

FIG. 3 illustrates a partial close-up view of an exemplary MCE 300. The MCE 300 is similar to the MCE 200 and the description of the features and design of the MCE 300 generally applies to the MCE 200 as well. Similar to the MCE 200, the MCE 300 includes a first end-tank 312, a second end-tank (not shown in FIG. 3), and a plurality of microchannels 310. The first end-tank 312 includes a second-fluid inlet 316 and a second-fluid outlet 318 that permit the second fluid to enter and exit the MCE 300. A baffle 320, similar to the baffle 220, is shown disposed between the second-fluid inlet 316 and the second-fluid outlet 318.

Each microchannel 310 of the plurality of microchannels 310 includes a fluid conduit through which the second fluid may flow. FIG. 3 also illustrates fins 332 that are disposed in gaps 330 between adjacent microchannels 310. The fins 332 help conduct heat from the first fluid to the second fluid by increasing the surface area contacted by the first fluid as it flows around the microchannels 310. In some embodiments, the fins 332 are spaced widely apart, such as, for example, 5 to 8.5 fins per inch, so as to not appreciably slow the flow of the first fluid through gaps 330 between the microchannels 310. Spacing the fins 332 widely also makes it easier to clean debris and sediment that may have settled upon the fins 332 and the plurality of microchannels 310. In other embodiments, the fins 332 may be spaced closer together in order to increase the surface area contacted by the first fluid to increase heat transfer from the first fluid to the second fluid. In some embodiments, the fins 332 may only be disposed along a portion of the length of the plurality of microchannels 310. In other embodiments, the MCE 300 may not include any fins 332.

In a typical embodiment, the each microchannel 310 of plurality of microchannels 310 has a rectangular cross-section. In other embodiments, the plurality of microchannels 310 may have other cross-sectional shapes, such as, for example, square, round, and the like. The plurality of microchannels 310 shown herein are not necessarily drawn to scale. The dimensions of the plurality of microchannels 310 can vary depending on the embodiment. For example, width, height, and length of the plurality of microchannels 310 can be changed in accordance with design preferences. The distance between the plurality of microchannels 310 that defines the size of the gaps 330 between the plurality of microchannels 310 may also be varied as desired.

Figure 4:
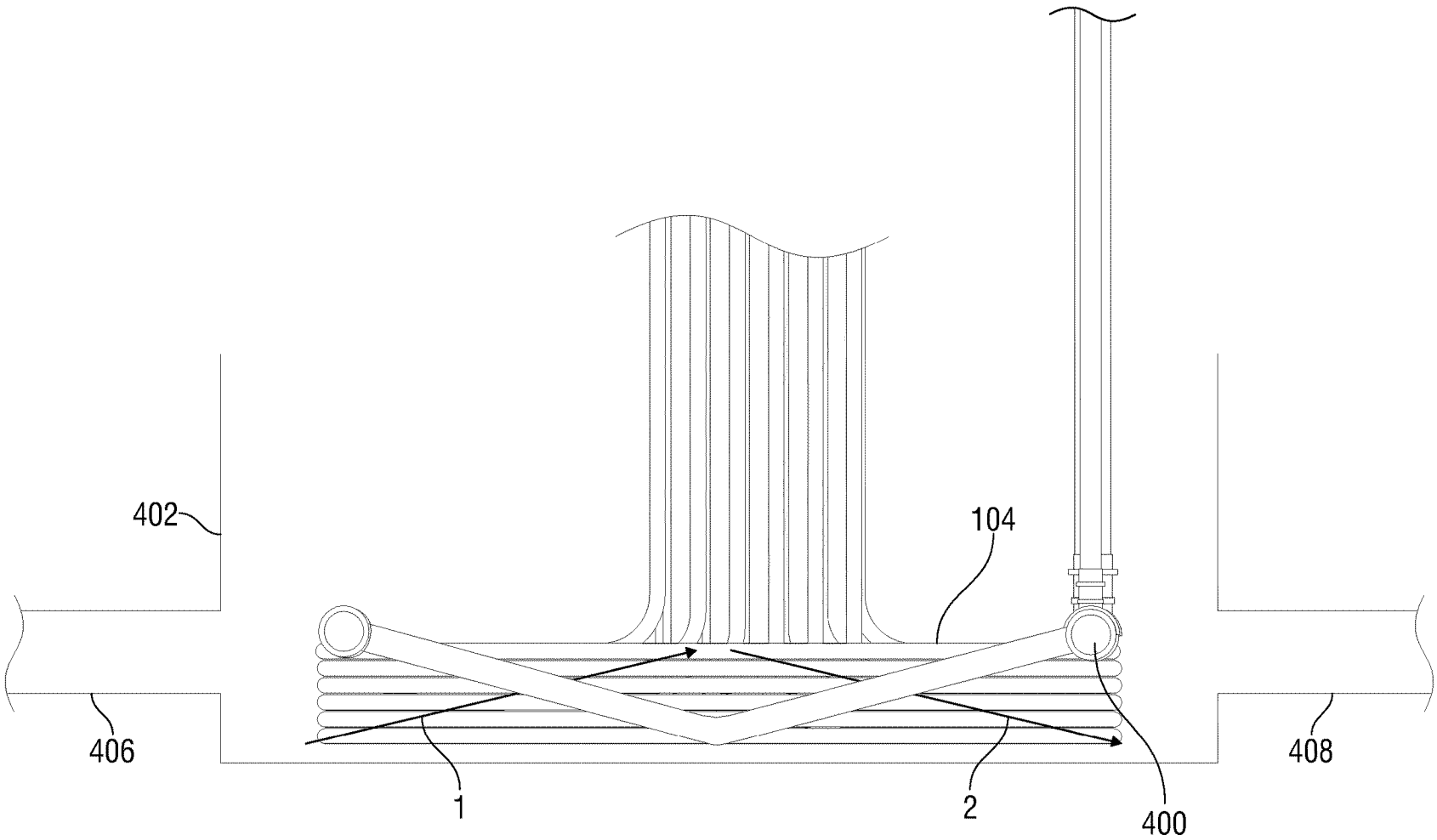
FIG. 4 illustrates an exemplary heat exchanger system with a microchannel evaporator heat exchanger superimposed on top of a prior art coiled-tube heat exchanger system.

FIG. 4 illustrates an exemplary heat exchanger system 401 comprising a fluid tank 402 with an MCE 400 superimposed over the flat evaporator 104 of FIG. 1. FIG. 4 demonstrates that the MCE 400 may be sized to be retrofitted into existing systems that utilize a flat evaporator. As shown in FIG. 4, the MCE 400 includes a bend along its length. By bending the MCE 400, a length of the microchannels may be increased while at the same time maintaining overall dimensions of the MCE 400 so as to not exceed the dimensions of the flat evaporator 104. Bending the MCE 400 also defines a flow path for the first fluid from a first-fluid inlet 406 to a first-fluid outlet 408 that forces the first fluid to pass through gaps between microchannels of the MCE 400. Arrows 1 and 2 demonstrate the first fluid's flow path through the fluid tank 402. In some embodiments, the MCE 400 may include, for example, multiple bends that force the fluid to pass between the microchannels of the MCE 400 a plurality of times. For example, the MCE 400 may comprise an 'N' shape, 'M' shape, and the like. In some embodiments, the MCE 400 may instead include no bends. If the MCE 400 includes no bends, the MCE 400 may be oriented at an angle relative to a base of the fluid tank so that the first fluid is forced to pass between the microchannels of the MCE 400 a single time as the fluid passes from the first-fluid inlet 406 to the first-fluid outlet 408. In some embodiments, one or more baffles may be included within the fluid tank 402 to cause the fluid to pass between the microchannels of an unbent MCE 400 multiple times, similar to the MCE 200.

Figure 5:
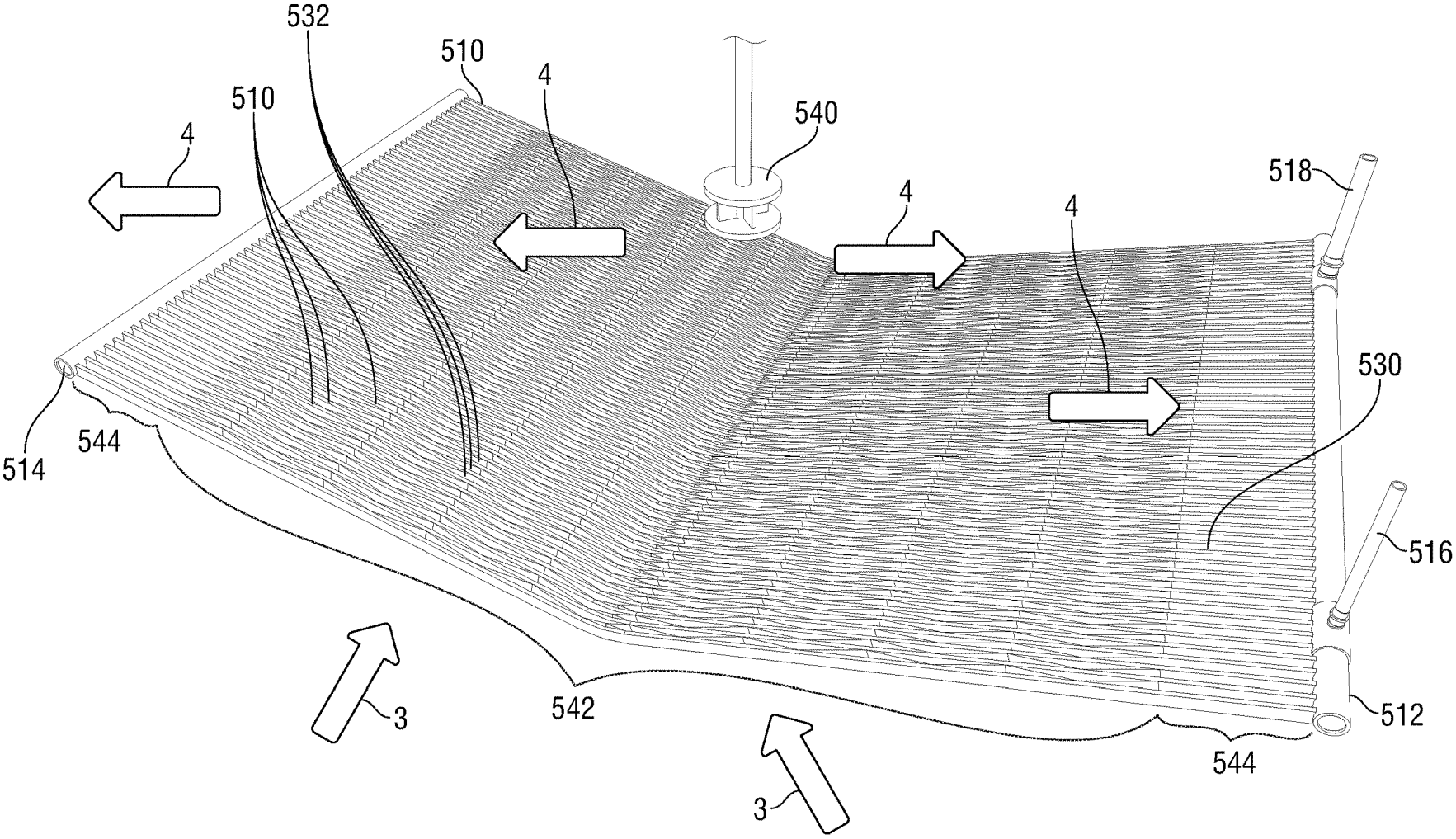
FIG. 5 illustrates an exemplary microchannel evaporator that includes an agitator.

FIG. 5 illustrates an exemplary MCE 500 that includes an agitator 540. The MCE 500 is similar to the MCE 200 discussed above and includes a first end-tank 512, a second end-tank 514, a plurality of microchannels 510, a second-fluid inlet 516, and a second fluid outlet 518. In a typical embodiment, the MCE 500 operates in a fluid tank, such as the fluid tank 402. For the purpose of clarity, the fluid tank is not shown in FIG. 5. The agitator 540 adds turbulence to the flow of the first fluid through the fluid tank. The turbulence increases a cooling efficiency of the MCE 500 by increasing contact between the first fluid and the MCE 500. The agitator 540 may be any of a variety of agitators. For example, the agitator 540 may be a pump-wheel agitator, an impeller, or a mixer. The agitator 540 may operate at various speeds depending on the type of agitator used and the amount of fluid movement desired. In some embodiments, a pump-wheel agitator may operate at a speed of around 3,000 rpm.

In some embodiments, fins 532 may be included in a central portion 542 of the MCE 500 and end portions 544 of the MCE 500 closest to end-tanks 512 and 514 may include no fins. Removal of the fins 532 from the end portions 544 makes it easier for the first fluid to pass through the end portions 544. In some embodiments, the fins 532 may extend the entire length of the plurality of microchannels 510. In some embodiments, the MCE 500 may include no fins 532. In some embodiments, the agitator 540 may be used to draw the first fluid from beneath the MCE 500 and expel the fluid laterally through end portions of the MCE 500 or vice versa. For example, arrows 3 illustrate a flow path of fluid being drawn from beneath the MCE 500 and arrows 4 illustrate a flow path of fluid being expelled laterally through end portions of the MCE 500.

Figure 6:
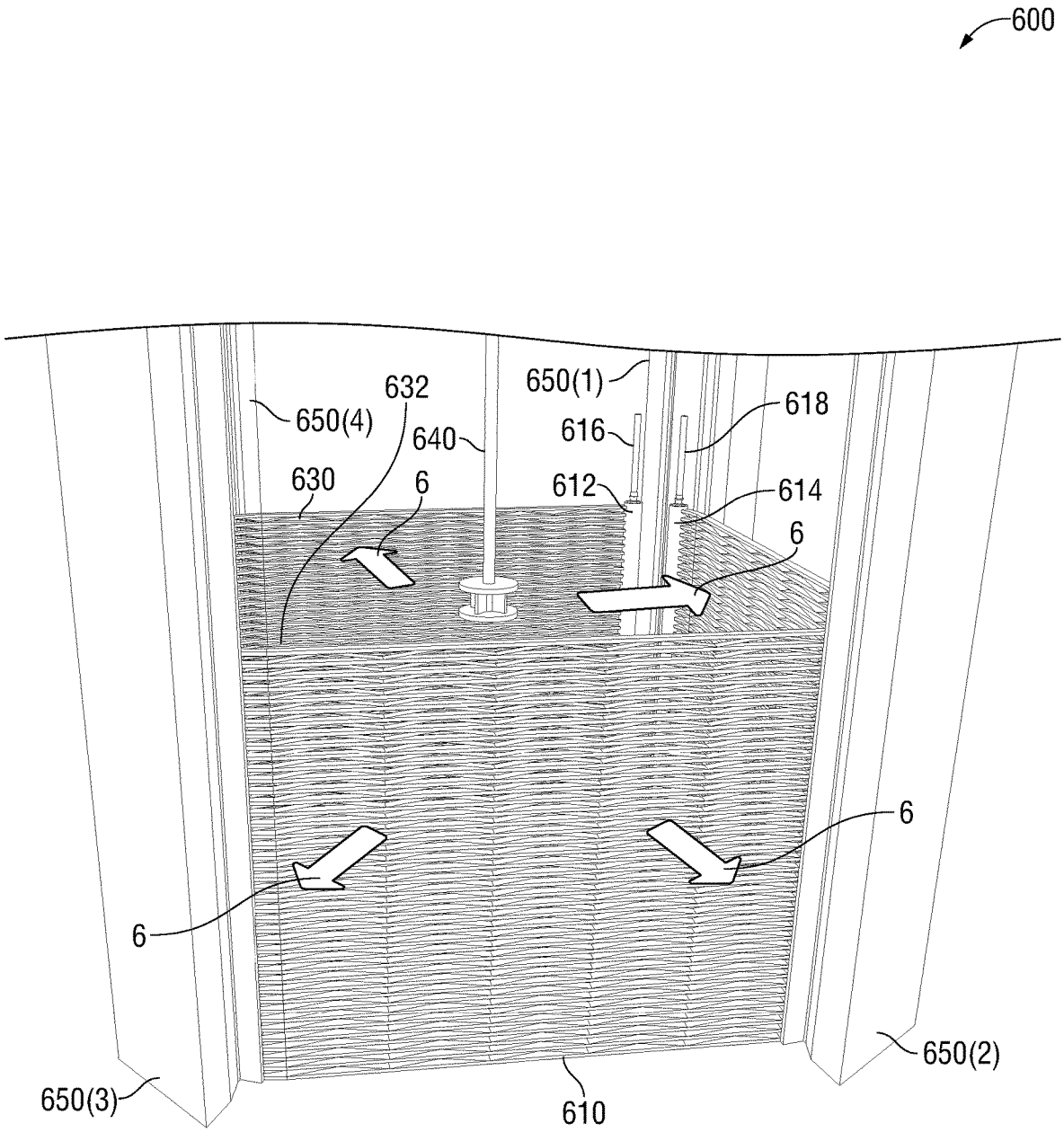
FIG. 6 illustrates an exemplary microchannel evaporator having a ring configuration.

FIG. 6 illustrates an exemplary MCE 600 having a ring configuration. In a typical embodiment, the MCE 600 operates in a fluid tank, such as the fluid tank 402. For the purpose of clarity, the fluid tank is not shown FIG. 6. As shown in FIG. 6, the MCE 600 is positioned between leg supports 650(1)-(4). The leg supports 650(1)-(4) provide support for a machine to be disposed above the MCE 600. First fluid from the machine may be circulated into the fluid tank in which the MCE 600 is disposed to cool the first fluid via heat exchange with the second fluid of the MCE 600. In a typical embodiment, the fluid tank is sized to generally surround the leg supports 650(1)-(4).

Similar to the MCEs 200, 300, 400, and 500, the MCE 600 includes a first end-tank 612 that is connected to a second end-tank 614 by a plurality of microchannels 610. A second-fluid inlet 616 of the first end-tank 612 and a second-fluid outlet 618 of the second end-tank permit the second fluid to circulate through the MCE 600.

To form the ring configuration, the first end-tank 612 and the second end-tank 614 are arranged adjacent to each other. The plurality of microchannels 610 are oriented horizontally and are arranged to generally follow a periphery of the fluid tank to substantially form a ring. A distance between sides of the MCE 600 and a wall of the fluid tank can be increased by reducing lengths of the sides of the MCE 600 (i.e., effectively reducing a diameter of the MCE 600). Increasing the space between the MCE 600 and the walls of the fluid tank can facilitate additional flow of the first fluid through the gaps 630 between the plurality of microchannels 610.

In some embodiments, the MCE 600 may be formed into other shapes according to various design parameters. For example, the MCE 600 may be cylindrically shaped. The number of rows of microchannels 610 may be varied according to various design parameters. Similar to the MCEs 200, 300, 400, and 500 discussed above, fins 632 may be placed in some or all of the gaps 630 between the plurality of microchannels 610 to increase efficiency of heat transfer between the first fluid and the second fluid.

In some embodiments, an agitator 640 may be used to impart energy into the first fluid to increase a flow of the first fluid with through the gaps between the plurality of microchannels 610, thereby increasing the heat transfer efficiency of the MCE 600. Arrows 5 generally illustrate a flow path of the first fluid. The agitator 640 may be any of a variety of agitators. For example, the agitator 640 may be a pump-wheel agitator, an impeller, or a mixer.

Figure 7:
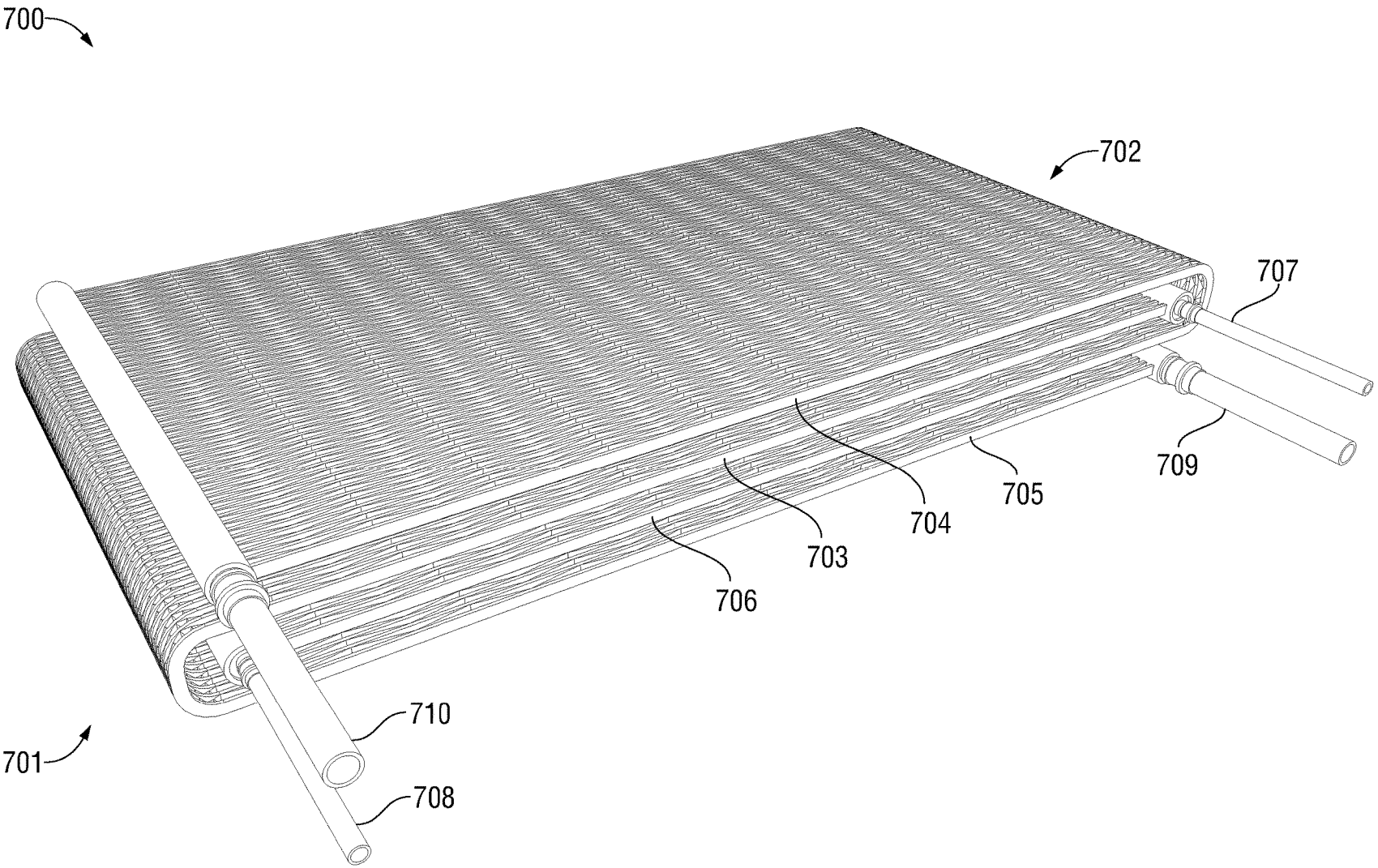
FIG. 7 illustrates an exemplary microchannel evaporator system that comprises a first microchannel evaporator and a second microchannel evaporator.

FIG. 7 illustrates an exemplary MCE system 700 that comprises a first MCE 701 and a second MCE 702. The MCEs 701 and 702 are structurally similar to the MCEs 200, 300, 400, 500, and 600 discussed above (e.g., each includes end-tanks that are joined by microchannels, an inlet, and an outlet). In a typical embodiment, the MCE 701 and the MCE 702 are essentially identical to each other. The MCEs 701 and 702 are substantially U-shaped. Substantially U-shaped is used herein to mean that each microchannel includes end portions that are generally parallel to one another. The MCE 701 includes a first panel 703 and a second panel 705 that form elongate portions of the 'U' when viewed from the side. The MCE 701 also includes a second-fluid inlet 707 and a second-fluid outlet 709 that permit the second fluid to circulate through the MCE 701. The MCE 702 similarly includes a third panel 704, a fourth panel 706, a second-fluid inlet 708, and a second-fluid outlet 710. The MCE 701 and MCE 702 are shaped so that either of the first panel 703 or the second panel 705 of the MCE 701 may fit between the third panel 704 and the fourth panel 706. For example, as shown in FIG. 7, the first panel 703 of the MCE 701 is shown positioned between the third panel 704 and the fourth panel 706 of the MCE 702. In the embodiment of FIG. 7, the MCE system 700 is configured with outer dimensions that are comparable to dimensions of the flat evaporator 104, and thus the MCE system 700 is compatible with existing fluid tanks. Compared to an embodiment utilizing a single MCE, the embodiment of FIG. 7 increases a surface area of contact between the first fluid and second fluid to improve heat transfer therebetween.

The MCEs 200, 300, 400, 500, 600, and 701/702 may be made from various materials. In some embodiments, the MCEs 200, 300, 400, 500, 600, and 701/702 may be constructed out of aluminum. In some embodiments, the MCEs 200, 300, 400, 500, 600, and 701/702 may include a coating to protect the MCEs 200, 300, 400, 500, 600, and 701/702 from the fluid in which it is immersed. For example, an MCE made from Aluminum may be plated with nickel, epoxy, and the like.

Each of the MCEs 200, 300, 400, 500, 600, and 701/702 described above may be made from various materials. In some embodiments, the MCEs 200, 300, 400, 500, 600, and 701/702 may be constructed out of aluminum. In other embodiments, the MCEs 200, 300, 400, 500, 600, and 701/702 may include a protective coating that protects the MCEs 200, 300, 400, 500, 600, and 701/702 from the fluid being cooled. Various types of protective coatings may be used depending on the type of first fluid being cooled. In some embodiments, the protective coating is a nickel coating.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A microchannel evaporator comprising:
- a plurality of microchannels, each microchannel of the plurality of microchannels comprising a first end and a second end;
- a first end-tank coupled to said each first end of the plurality of microchannels;
- a second end-tank coupled to said each second end of the plurality of microchannels;
- an inlet coupled to either the first end-tank or the second end-tank and configured to receive a fluid into the microchannel evaporator;
- an outlet coupled to either the first end-tank or the second end-tank and configured to expel the fluid from the microchannel evaporator;
- a baffle disposed within the first end-tank, wherein the baffle is located closer to the inlet than the outlet;
- at least one fin disposed between at least two microchannels of the plurality of microchannels;
- wherein each microchannel of the at least two microchannels has a length that extends between the first and second end-tanks, the length being made up of a central portion, wherein the central portion comprises the length between a first end portion closest to the first end tank and a second end portion closest to the second end tank;
- wherein the at least one fin extends along only the central portion;
- wherein the first end portion closest to the first end tank and the second end portion closest to the second end tank do not include the at least one fin; and
- wherein a sum of the length of the first end portion and the second end portion is approximately 20% of the length of said each microchannel that extends between the first and second end-tanks.

2. The microchannel evaporator of claim 1, wherein a diameter of the outlet is larger than a diameter of the inlet.

3. The microchannel evaporator of claim 1, wherein said each microchannel of the plurality of microchannels has a rectangular cross-section.

4. The microchannel evaporator of claim 1, wherein the microchannel evaporator comprises a coating of nickel.

5. The microchannel evaporator of claim 1, wherein the first end-tank and the second end-tank are disposed adjacent to each other.

6. The microchannel evaporator of claim 5, wherein the plurality of microchannels are arranged to generally follow a periphery of a fluid tank in which the microchannel evaporator is placed.

7. The microchannel evaporator of claim 1, wherein the at least one fin comprises a plurality of fins, the plurality of fins having a fin spacing of between 5 to 8.5 fins per inch.

8. The microchannel evaporator of claim 1, wherein the baffle divides the first end-tank into a first section and a second section.

9. The microchannel evaporator of claim 8, wherein the baffle directs the fluid from the first section to the second section.

* * * * *